US008138135B2

(12) United States Patent
Moore et al.

(10) Patent No.: US 8,138,135 B2
(45) Date of Patent: Mar. 20, 2012

(54) POWDER CLEANING COMPOSITION

(75) Inventors: Patrick D Moore, Pacolet, SC (US); Lacey Hillard, Spartanburg, SC (US); Leonard J. Starks, Duncan, SC (US); Steven E. Brown, Spartanburg, SC (US); David E. Green, Simpsonville, SC (US); Daniel Y. West, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 12/383,633

(22) Filed: Mar. 27, 2009

(65) Prior Publication Data

US 2010/0249011 A1 Sep. 30, 2010

(51) Int. Cl.
*C11D 3/37* (2006.01)
*C11D 17/06* (2006.01)

(52) U.S. Cl. ..... 510/278; 510/475; 510/477

(58) Field of Classification Search ..... 510/278, 510/475, 477, 509
See application file for complete search history.

(56) References Cited

U.S. PATENT DOCUMENTS

| | | | | |
|---|---|---|---|---|
| 2,165,586 | A | 1/1936 | Studer et al. | |
| 3,418,243 | A | 12/1968 | Hoxie et al. | |
| 3,956,162 | A | 5/1976 | Lautenberger | 252/162 |
| 4,013,594 | A | 3/1977 | Froehlich et al. | 252/544 |
| 4,108,800 | A | 8/1978 | Froehlich | 252/541 |
| 4,194,993 | A | 3/1980 | Deal, III | 252/541 |
| 4,252,694 | A * | 2/1981 | Lewis et al. | 510/382 |
| 4,434,067 | A | 2/1984 | Malone et al. | 252/88 |
| 4,566,980 | A | 1/1986 | Smith | 252/8.6 |
| 4,655,952 | A * | 4/1987 | Mesmer et al. | 510/278 |
| 4,659,494 | A | 4/1987 | Soldanski et al. | 252/88 |
| 4,753,746 | A * | 6/1988 | Mesmer et al. | 510/278 |
| 4,802,997 | A | 2/1989 | Fox et al. | 252/8.6 |
| 4,834,900 | A | 5/1989 | Soldanski et al. | 252/88 |
| 4,873,000 | A | 10/1989 | Weller | 252/8.6 |
| 4,908,149 | A | 3/1990 | Moore et al. | 252/139 |
| 5,714,449 | A | 2/1998 | Donker et al. | 510/304 |
| 5,783,543 | A | 7/1998 | Fleckenstein et al. | 510/280 |
| 5,786,317 | A | 7/1998 | Townsend | 510/278 |
| 6,010,539 | A | 1/2000 | Del Pesco | 8/137 |
| 6,569,210 | B1 | 5/2003 | Chao et al. | 8/137 |
| 6,669,391 | B2 | 12/2003 | Policicchio et al. | 401/270 |
| 7,101,834 | B2 * | 9/2006 | Gagliardi et al. | 510/278 |
| 2002/0090453 | A1 | 7/2002 | Muthiah et al. | 427/180 |
| 2002/0174500 | A1 | 11/2002 | Micciche | 15/104.93 |
| 2005/0183206 | A1 * | 8/2005 | Brown et al. | 8/137 |
| 2005/0261154 | A1 | 11/2005 | Hammock | 510/267 |
| 2007/0072787 | A1 * | 3/2007 | Hazenkamp et al. | 510/446 |

FOREIGN PATENT DOCUMENTS

| | | |
|---|---|---|
| CA | 985113 | 3/1976 |
| CA | 2107409 | 4/1994 |
| EP | 0 392 248 | 10/1990 |
| EP | 1 184 449 | 3/2002 |
| EP | 1 063 282 | 8/2003 |
| EP | 1 834 654 | 9/2007 |
| FR | 2015972 | 4/1970 |
| JP | 4 185700 | 7/1992 |
| WO | WO 00/78448 | 12/2000 |
| WO | WO 01/64179 | 9/2001 |

OTHER PUBLICATIONS

International Search Report Application No. PCT/US2010/000894 Date of Mailing Jul. 30, 2010.

* cited by examiner

*Primary Examiner* — Lorna M Douyon
(74) *Attorney, Agent, or Firm* — Brenda D. Wentz

(57) ABSTRACT

This invention relates to improved powder cleaning compositions and methods for cleaning textile substrates, especially carpet and upholstery fabrics. More particularly, this invention relates to powder cleaning compositions that contain absorbent particulate materials in a flowable form, which dries to a soil ladened powder, that can be removed by vacuum, brushing, and/or laundering methods. The improvement lies in the ability of the composition to remain a flowable powder, while containing a higher water content than previous powder cleaning compositions. The composition comprises an absorbent particulate material, a super absorbent polymer, and other ingredients.

15 Claims, No Drawings

POWDER CLEANING COMPOSITION

FIELD OF THE INVENTION

This invention relates to improved powder cleaning compositions and methods for cleaning textile substrates, especially carpet and upholstery fabrics. More particularly, this invention relates to powder cleaning compositions that contain absorbent particulate materials in a flowable form, which dries to a soil ladened powder, that can be removed by vacuum, brushing, and/or laundering methods. The improvement lies in the ability of the composition to remain a flowable powder, while containing a higher water content than previous powder cleaning compositions. The composition comprises an absorbent particulate material, a super absorbent polymer, and other ingredients.

BACKGROUND OF THE INVENTION

The methods of cleaning of textile substrates may be generally placed into three categories. The first category involves the immersion of the textile into a cleaning solvent followed by agitation and removal of soiled solvent. In this case, water is the preferred solvent, provided that the fiber and/or textile substrate is stable to it. Typically, the additives used to facilitate soil removal by the solvent are surfactants, ionic chelators, and pH adjusters. Other minor ingredients are generally included to enhance the cleaning process. These include fragrances, bleaches, optical brighteners, and anti-resoil ingredients. For example, U.S. Pat. Nos. 5,786,317; 6,010,539; and 5,714,449 to Donker, et al., describe a non-aqueous liquid cleaning composition containing solid particles suspended by the use of hydrophobically modified silica particles. This composition is designed for liquid detergent concentrates for washing machine applications and the particles are active bleaching agents. If the textile is small, this process generally uses standard washing machines or dry cleaning machines to clean the textile. If the textile is large or physically affixed to an object, this process uses portable liquid applicators and vacuum retrieval of the soiled fluid. This method, often referred to as "hot water extraction," applies a substantial amount of water based cleaning solution to the textiles, such as a carpet or upholstery, and uses vacuum extraction to partially remove the soil and surfactant laden cleaning solution. This process typically leaves a residual surfactant on a carpet that attracts dirt to its surface and provides a wet textile that can take many hours to completely dry. The water in the composition is known to cause rust stains if it comes into contact with iron-containing objects, as well as, to provide enhanced growing conditions for mold and other microorganisms. These deficiencies are substantially overcome by powdered cleaning compositions.

The second general category of methods for cleaning textiles involves applying foam-containing solvents and surfactants to the textile followed by agitation with a brush or damp mop. Typically, the applied foam collapses after contact with the textile, and the spots and soil become less visible. While the appearance on the surface of the textile, such as a carpet, is improved, very little dirt or surfactant is actually removed. The main advantages of this method are the ability to use household tools and equipment and the rapid cleaning cycle. Canadian Patent No. 985113, assigned to Unilever Limited, shows a variation on this wherein a non-scrub foam, which contains soil retardant particles, is applied to the carpet. These soil retardant particles remain as a residue on the carpet after the other components of the foam are removed by vacuuming. While this method can be used to improve the appearance of a carpet, it is not an effective method of removing dirt. Furthermore, it leaves a substantial amount of residue on the carpet.

The third general category of methods of cleaning textiles involves applying a solid composition that contains a solvent and a cleaning surfactant to the textile followed by agitation. Typically, the solvent is allowed to evaporate and the soiled particles are retrieved with a vacuum cleaner or removed by brushing. Powdered cleaning compositions, or other dry-type cleaning compositions, generally contain, in addition to a liquid component and surfactant component, any of a rather wide variety of both natural and synthetic solid particulate materials. Natural solid particulate materials include, for example, buckwheat flour (see U.S. Pat. No. 2,165,586 to Studer), wood flour, and diatomaceous earth of specific particle size and low bulk density (see U.S. Pat. No. 3,418,243 to Hoxie). Synthetic solid particulate materials include, for example, polymeric materials such as polyurethanes, polystyrenes and phenolformaldehyde resin particles, as disclosed, for example, in French Patent No. 2,015,972. Several examples of powdered cleaning compositions are discussed below.

U.S. Pat. No. 4,013,594 to Froehlich et al. discloses a powdered cleaning composition that contains, as a major component, solid polymeric urea-formaldehyde particles and a solvent component which may be chosen from water, high boiling hydrocarbon or chlorinated hydrocarbon solvents, aliphatic alcohols and mixtures of such compounds.

U.S. Pat. No. 4,108,800 to Froehlich discloses a semi-dry powdered cleaning composition which further contains polyethylene glycol as an aid to prevent the adherence of fine particles to the fibers being cleaned. This reference further describes the visual problem of "frosting" that occurs when small particles are formed from particle to particle attrition as a result of agitation, such as by brushing.

U.S. Pat. No. 4,194,993 to Deal discloses a process for making a powdered cleaning composition which includes the steps of polymerizing urea and formaldehyde in acidic solution to form particles of a desired size, centrifuging the particles, blending polyethyleneoxide into the polymer, and spraying a fine mist of detergent solution onto the polymer mass as it is blended.

U.S. Pat. No. 4,434,067 to Malone et al. discloses a powdered cleaning composition that contains, in addition to a particulate polymeric material such as urea formaldehyde, an inorganic salt adjuvant and an aqueous or organic fluid component. The Examples and the Tables illustrate that the maximum content of fluid in these powdered cleaning compositions as 40% of the total composition. They further describe the formation of pastes and non-flowable solids when the liquid level or the inorganic salt adjuvant component represents too high a proportion of the total composition.

U.S. Pat. No. 4,802,997 to Fox et al. discloses a cleaning composition that contains a hydrogel polymer that acts as a carrier for a treatment liquid. The composition may be sprinkled on a textile surface and is capable of ejecting the treatment liquid under mechanical pressure or brushing. The hydrogel polymer is then capable of reabsorbing the treatment liquid when the mechanical pressure or brushing is removed. The hydrogel polymers preferably have a particle size distribution wherein the majority of the particles are greater than 250 microns. The cleaning composition may also include flow aids, such as chalk or cellulose materials, to improve flow characteristics of the composition.

U.S. Pat. No. 4,659,494 to Soldanski et al. describes a cellulose powder containing dry carpet cleaner with reduced dusting, particularly if the carpet cleaner did not contain added surfactant.

U.S. Pat. No. 4,908,149 to Moore et al. discloses improved carpet cleaning compositions that include acid dye stain blocker additives. These compositions range from particle-free solutions to dry-type powders with a minimum of 30% solid particle content.

U.S. Pat. No. 4,873,000 to Weller discloses a powdered freshening and deodorizing composition for carpets. The composition contains inorganic salts in combination with aluminum silicate clay to improve vacuum retrieval. The composition further contains a maximum of 4% liquid comprised of fragrance and organic agglomerating agent.

EP 1,063,282 B1 to Lang et al. discloses a cellulose-based, porous, particle gel carpet cleaning composition in combination with water and alcohol. This composition remains in the gel state even in the presence of an 80% water and alcohol mixture.

U.S. Pat. No. 5,783,543 to Fleckenstein discloses a scatterable powdered cleaning composition incorporating viscose sponge flakes from 3 to 10 mm in length. The improved composition results in less disruption of the carpet fibers due to the brushing process.

EP 1184449 to Gagliardi et al. describes a solid cleaning composition with low water content that is particularly useful for cleaning wet spills. The composition incorporates water swellable polymers and anhydrous salts to absorb liquid and turn wet spills into powders that can be removed by vacuum cleaners. The cleaning of wet spills by conventional powdered cleaning agents is problematic due to the potential to form pastes that are not vacuum retrievable.

U.S. Pat. No. 6,569,210 to Chao et al. describes a novel fabric cleaning method whereby soils are treated with a particulating chemical, such as a colorless sulfonated dye site blocker, to generate particles that are then removed by gas jet interaction.

U.S. Pat. No. 6,010,539 to Pesco discloses a modern example of cleaning compositions for hot water extraction systems. This composition is free of organic solvents and contains water, detergent builders (such as sodium tripolyphosphate), EDTA, non-ionic surfactants, stain soluble resist polymers (such as methacrylic acid salts) and a fluorosurfactant.

Thus, as is illustrated by the previous efforts of others, the use of solid cleaning agents for carpet or upholstery has been recognized as the superior method of cleaning. Its low water content allows both for rapid drying and safe cleaning of even expensive wool carpets. The hand application (i.e. sprinkling and spraying methods) and brushing followed by retrieval using the household vacuum cleaner requires no specialized machinery. The particles absorb both sticky soils and residual surfactants so that the textile remains cleaner much longer. In addition, solid cleaning agents have been established to effectively remove allergens, while not promoting the growth of micro-organisms.

There are, however, limitations to the use of solid cleaning agents. Powdered cleaning compositions contain a maximum level of water to aide in cleaning efficacy. At this level of water content, powdered cleaning compositions are not free-flowing. The damp powder clumps and cannot be sifted through small holes for use by the consumer.

The solid cleaning agents may be characterized by the classical Critical Pigment Volume (CPV) effect. The CPV is also known as the oil value, which may be determined by ASTM D281 and which is described, for example, in U.S. Pat. No. 3,956,162 to Lautenberger. To remain a flowable powder, the maximum liquid content is restricted to below the CPV. For particles of a certain shape, the CPV is the volume between particles filled with air. As the air is displaced by a fluid, the flow properties of the powder are reduced until, at the CPV, all the particles are surrounded by liquid. At that point, the mass has the consistency of putty. If more fluid is added, the putty gradually thins until a paint-like dispersion is generated. The practical problem of prior art solid cleaning compositions is that when wet spills are cleaned with powdered cleaning agents, it is possible to generate a paste consistency that, when brushed, does not remain free-flowing. This creates a spot that is very difficult to remove. In addition, if brushing occurs at the thick dispersion or paste stage the particle size can be mechanically reduced by particle to particle attrition. Particles having a particle size of less than about 5 microns are held very tightly by electrostatic force and are very difficult to remove by vacuum cleaners. This also leads to an observable residual spot of cleaner on the textile. Therefore, there is the need to provide a solid containing cleaning composition that avoids the practical side effects of the Critical Pigment Volume.

Additionally, in some instances, consumers have complained that the prior art powder cleaning compositions form clumps in the package and do not evenly disperse. These issues also detrimentally affect the manufacturing process because the composition may clog machine parts.

Thus, the need exists for an improved powder cleaning composition that addresses these issues. The composition of the present invention exhibits improved dispersing properties and less clumping, and therefore, provides a product that is easier to manufacture. At the same time, it allows for a higher water content to be present in the composition and still remain a free-flowing powder.

Attempts by others have included the incorporation of polyacrylic acid into cleaning formulations. For instance, US Patent Publication No. 2005/0261154 to Hammock discloses a surfactant-free cleaning composition that leaves a redeposition of particle coating on fibers containing polyacrylic acid sodium salt. US Patent Publication No. 2002/0090453 to Muthiah et al. discloses an article to which super absorbent particles are attached by a curable resin linkage which provides a reduction in particle loss. End-use applications include diapers and cleaning devices. WO 01/64179A1 to Jehn-Rendu et al. discloses a non-abrasive skin cleaning composition containing super absorbent polymers and polyacrylic acid. WO 00/78448 to Pierce teaches a method and device for cleaning liquid spills that is the blend of two super absorbent polymers that, when contacted with water, forms a unitary mass that is removable.

Canadian Patent Application No. 2107409 to Hughes et al. teaches modifying polyacrylic acid with free radical treatment to combine polymer chains to provide materials useful in cleaning and detergent formulations. U.S. Pat. No. 4,834,900 to Soldanski et al. discloses a two step process for cleaning stains from carpet using hydroxymethyl cellulose thickened liquid detergent followed by application of three times the original amount of a dry cellulose powder composition. U.S. Pat. No. 4,566,980 to Smith teaches a dry carpet cleaning composition containing inorganic carrier salts and agglomerating starch coated with polyethylene wax and polyacrylic acid.

It is thus an object of this invention to blend super absorbent particles with an absorbent particulate material to produce a free-flowing powdered cleaning composition that contains an even higher water content than the prior art powdered cleaning compositions. In addition, this composition, when used for wet spots or with normal pre-spray applications, greatly speeds the dry time and does not leave white spot residue. The super absorbent polymer particles may be pre-moistened before blending, yet they retain the ability to absorb up to 30 times their weight in water. Even when wet, the particles do not become sticky and retain the ability to be removed by vacuuming. This is in marked contrast to polyacrylate salts that form gels which glue particles to the fibers of the textile substrate.

DETAILED DESCRIPTION OF THE INVENTION

Reference now will be made to the various embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. All patents, published patent applications, and any other publications mentioned in this patent application are herein incorporated by reference.

This invention relates to improved powder cleaning compositions and methods for cleaning textile substrates, particularly carpet and upholstery fabrics. More particularly, the present invention relates to compositions that retain the advantages of solid carpet cleaning compositions, such as remaining a free-flowing powder, while at the same time containing a higher water content.

The improved powder cleaning composition generally comprises an absorbent particulate material, a super absorbent polymer, and other ingredients. Other ingredients include, without limitation, organic liquids, surfactants, surface active agents, static reducing additives, dust suppressing additives, vacuum retrieval additives, metal ion chelators, stain resist agents, pH adjusters, fragrance, biocides, water, and the like. The absorbent particulate material, super absorbent polymer and other ingredients comprising the improved powder cleaning composition may be present in any of a number of combinations, as may be determined by the specific end-use of the powder cleaning composition.

Absorbent Particulate Materials

The absorbent particulate materials may be selected from a wide variety of solid materials. The solid materials may include naturally occurring materials, such as wood particles (like sawdust or wood flour), particles made from grains and other vegetable matter, diatomaceous earth particles, cellulosic particles and inorganic particles (such as silicates, borates, etc.). The solid material may also be a synthetic material, such as a synthetic resin material. Synthetic resin materials include, for example, urea formaldehyde polymer, such as those disclosed in commonly assigned U.S. Pat. Nos. 4,434,067 and 4,908,149. Other synthetic resin materials include, for example, polyurethane, polystyrene, and phenol-formaldehyde resin particles, similar to the type disclosed in French Patent No. 2,015,972 assigned to Henkel Et Co Gmbh. Still other absorbent particulate materials include water insoluble inorganic salt adjuvants such as, for example, sulfates, carbonates (such as calcium carbonate), borates, citrates, phosphates, metasilicates and mixtures thereof.

The absorbent particulate material may be present in the composition in an amount between 0.1% and 75% by weight based on the total weight of the composition, more preferably between 10% and 65% by weight based on the total weight of the composition, and even more preferably between 25% and 60% by weight based on the total weight of the composition.

Average particle size of the absorbent particulate material may be from about 10 microns to about 300 microns in diameter as determined by sieve analysis. It may be more preferable that the average particle size of the particulate is from about 10 microns to about 200 microns in diameter as determined by sieve analysis. It may be even more preferable that the average particle size of the particulate material is from about 10 microns to about 105 microns in diameter as determined by sieve analysis. It may yet be even more preferable that the average particle size of the particulate is from about 35 microns to about 105 microns as determined by sieve analysis. In general, it may be preferable for some applications that the particle size distribution should be such that not more than about 10 percent of the particles are larger than about 105 microns and in general no more than about 5 percent of the particles are smaller than about 10 microns. Larger particles typically do not penetrate carpet material adequately, and use of such particles would result in only superficial cleaning at best. Larger particles also have insufficient surface area to absorb a large amount of soil per unit of weight. If the particles are smaller than about 10 microns in diameter, they may adhere to the individual carpet fibers and have a delustering or dulling effect on the color of the carpet. While particles between about 10 and 35 microns may be tolerated, they may not contribute to cleaning efficiency to any substantial extent so that the average particle size should be in excess of 35 microns.

As discussed previously, the absorbent particles may be further characterized by the classical Critical Pigment Volume (CPV) effect, also known as the oil value or oil absorption value. This value may be determined by ASTM D281 and is described, for example, in U.S. Pat. No. 3,956,162 to Lautenberger. To remain a flowable powder, the maximum liquid content is restricted to below the oil absorption value. For particles of a certain shape, the oil absorption value is the volume between particles filled with air. As the air is displaced by a fluid, the flow properties of the powder are reduced until, at the oil absorption value, all the particles are surrounded by liquid. Accordingly, it may be preferred that the absorbent particles have an oil absorption value of at least 40. It may be more preferable that the absorbent particles have an oil absorption value of at least 60.

One potentially preferred, non-limiting solid material for use in such compositions is the type which has been disclosed in U.S. Pat. No. 4,013,594 to Froehlich et al. wherein particulate, polymeric urea formaldehyde particles were proposed for use in dry-type cleaning compositions. These particulate urea formaldehyde materials were distinguished in the Froehlich patent from those of the earlier French Patent No. 2,015,972 based upon a fairly broad range of parameters. Of particular interest was the disclosure that the particles described in the Froehlich patent, as compared to the particles of the French patent, possessed a somewhat higher bulk density of at least about 0.2 grams per cubic centimeter. Such higher bulk density characteristics resulted in generally increased cleaning effectiveness as compared to the prior art particles. With respect to urea formaldehyde particles, it is noted that these particles may contain approximately 35-40% moisture content when manufactured.

Super Absorbent Polymers ("SAPs")

Super absorbent polymers may include those polymers made from partially neutralized, lightly cross-linked poly (acrylic) acid compounds. Several commercially available super absorbent polymers that may suitable for incorporation into the present cleaning composition include the Luquasorb® products available from BASF, such as Luquasorb® 1010, Luquasorb® 1003, Luquasorb® MA 1110 and the Hysorb™ products available from BASF such as Hysorb™ 8400.

It has also been noted that some super absorbent polymers change color over time and exhibit shades of yellow or brown. These particular SAPs may be less desirable for use, since it is intended that the improved powdered cleaning composition remain white in color.

It is believed that smaller particle size SAPs absorb liquid much faster due to increased surface area. Thus, particle size of the dry SAPs may be in the range of 20-600 microns in diameter, more preferably in the range of 40-300 microns in diameter, and even more preferably in the range of 40-100 microns in diameter. It may be most preferable that the particle size of the SAPs is in the range of 60-80 microns in diameter. After absorbing liquid, the wet SAPs may swell to a size of 80-100 microns in diameter.

Super absorbent polymers may be present in the composition in an amount between 0.1% and 20% by weight based on the total weight of the composition, more preferably between 1% and 10% by weight based on the total weight of the composition, and even more preferably between 3% and 8% by weight based on the total weight of the composition.

Typically, the presence of between 3% to 8% of SAP in the composition allows the water content of the composition to be in the range of 55% to 80% and still maintain a powdered cleaning composition that has good flow properties. The presence of the SAP in the composition does not detrimentally affect the cleaning properties of the composition. Rather, it has been found that the cleaning properties are as good as that observed from cleaning substrates with the comparison composition that does not contain the SAP. Additionally, the retrieval properties (the ability to remove all, or nearly all, of the composition from the substrate being cleaned) are improved over the composition that does not contain the SAP.

Other Ingredients

The following other ingredients or additives may be present in the improved powder cleaning composition in amounts ranging between 0.01% and 10% by weight based on the total weight of the composition. Other ingredients include, without limitation, organic liquids, surfactants, surface active agents, static reducing additives, dust suppressing additives, vacuum retrieval additives, metal ion chelators, stain resist agents, pH adjusters, fragrance, biocides, water, and the like. However, as will be discussed below, the amount of water may be present in amounts that are higher than this range.

Examples of organic liquids which can be used include, without limitation, $C_1$ to $C_4$ aliphatic alcohols, high boiling hydrocarbon solvents, and mixtures thereof. The hydrocarbon solvents are generally the petroleum distillates with a boiling point between about 100° C. and about 300° C. Low boiling organic liquids are generally unsuitable from a standpoint of vapors and flammability, and higher boiling organic liquids do not evaporate from the textile substrate at an adequately rapid rate. Examples of commercially available hydrocarbon solvents include Stoddard solvent and odorless hydrocarbon solvent. These solvents usually consist of a petroleum distillate with a boiling point between about 105° and about 200° C. Properties of these solvents are comparable to those of British Standard White Spirits and domestic mineral spirits. Chemically, these solvents consist of a number of hydrocarbons, principally aliphatic, in the decane region. One potentially preferred, non-limiting organic liquid is a high boiling hydrocarbon solvent. Organic liquids may be present in the improved powder cleaning composition in amounts ranging between 0.01% and 10% by weight.

Surfactants of a number of classes are satisfactory for use in the compositions of this invention. The selection of a surfactant is not critical but the surfactant should serve to lower the surface tension of the water in the composition to about 40 dynes per centimeter or less. Preferred anionic surfactants are long chain alcohol sulfate esters, such as those derived from $C_{10}$-$C_{18}$ alcohols sulfated with chlorosulfonic acid and neutralized with an alkali. Also preferred are alkylene oxide additives of $C_6$-$C_{10}$ mono and diesters of ortho-phosphoric acid. Representative nonionic surfactants that can be used have the formula:

$$R(\overset{\overset{C_nH_{2n}+1}{|}}{OCH}—CH2)_mR^1$$

where n is 0 or 1, m is 3 to 20, $R^1$ is OH or $OCH_3$, R is $C_{12}$ to $C_{22}$ alkyl or phenyl
or naphthyl optionally substituted by $C_1$ to $C_{10}$ alkyl groups.

The surfactant can be a nonionic surfactant or a mixture of a nonionic surfactant and either an anionic surfactant or a cationic surfactant. Mixtures of anionic and cationic surfactants are suitable only in carefully selected cases. A preferred composition contains from about 1 to about 4% nonionic surfactant. A satisfactory mixture of commercial anionic surfactants comprises (1) 0.4% of the sodium salt of a mixture of $C_{10}$-$C_{18}$ alcohol sulfates, predominantly $C_{12}$, (2) 0.4% of the diethylcyclohexylamine salt of the same sulfate mix, and (3) 0.2% of the product formed by reacting a mixture of n-octyl mono and diesters of ortho-phosphoric acid with sufficient ethylene oxide to form a neutral product, ordinarily about 2 to 4 moles of ethylene oxide per mole of phosphoric ester.

Surfactants may be present in the improved powder cleaning composition in amounts ranging between 0.01% and 10% by weight. However, the surfactant may more preferably be present in amounts ranging from about 0.5 to about 5.0% by weight.

Vacuum retrieval additives include, for example, compounds such as polyoxyalkylene materials (such as dipropylene glycol), aluminum silicate clay, hydrolyzed styrene maleic anhydride, and mixtures thereof. Polyoxyalkylene materials (such as dipropylene glycol), as well as non-volatile organic solvents (such as mineral oil), and mixtures thereof may also be used as dust suppressing additives. Aluminum silicate clay may also be used as a static reducing additive.

Metal ion chelators include such compounds, for example, as ethylene diamine tetraacetic acid (EDTA). Stain resist agents include such compounds as, for example, acrylic stain blockers. Such compounds as aqua ammonia, citric acid, and mixtures thereof may be included as pH adjusters. Biocides may be included to prolong the shelf life of the cleaning composition. These may include, for example, compounds such as potassium sorbate, isothiazolones and mixtures thereof. Fragrances may also be included in the composition to impart a desirable odor to the composition. Any of the above ingredients or additives may be present in the improved powder cleaning composition in amounts ranging between 0.01% and 10% by weight.

The amount of water added to the cleaning composition may depend on the amount of super absorbent polymer adding to the improved powder cleaning composition. However, in general, it may be desirable that the amount of water added to the composition is between 20% and 90% based on the total weight of the composition. It may be more preferable that the amount of water added to the composition is between 30% and 70% based on the total weight of the composition. It may be most preferable that the amount of water added to the composition is between 40% and 60% based on the total weight of the composition. In some instances, it may ideal that the amount of water is greater than the amount of absorbent particulate material present in the composition.

Thus, it may be ideal that the improved powder cleaning composition is comprised of between 0.1% and 75% by weight of at least one absorbent particulate material; between 0.1% and 20% by weight of at least one super absorbent polymer; between 20% and 90% by weight of water, wherein the water may also contain a surfactant sufficient to provide a surface tension of less than about 40 dynes per centimeter; and between 0.01% and 10% by weight of at least one additive selected from an organic liquid, a stain resist agent, a pH adjuster, a biocide, a static reducing additive, a dust suppressing additive, a vacuum retrieval additive, a metal ion chelator, and a fragrance.

It may be more preferable that the cleaning composition is comprised of between 10% and 65% by weight of at least one absorbent particulate material; between 1% and 10% by weight of at least one super absorbent polymer; between 30% and 70% by weight of water, wherein the water may also contain a surfactant sufficient to provide a surface tension of less than about 40 dynes per centimeter; and between 0.01% and 10% by weight of at least one additive selected from an organic liquid, a stain resist agent, a pH adjuster, a biocide, a static reducing additive, a dust suppressing additive, a vacuum retrieval additive, a metal ion chelator, and a fragrance.

Further, it may be preferable that the cleaning formulation is comprised of between 25% and 60% by weight of at least one absorbent particulate material; between 3% and 8% by weight of at least one super absorbent polymer; between 40% and 60% by weight of water, wherein the water may also contain a surfactant sufficient to provide a surface tension of less than about 40 dynes per centimeter; and between 0.01% and 10% by weight of at least one additive selected from an organic liquid, a stain resist agent, a pH adjuster, a biocide, a static reducing additive, a dust suppressing additive, a vacuum retrieval additive, a metal ion chelator, and a fragrance.

In preparing the improved powdered cleaning composition, it may be desirable to add the super absorbent polymer to the absorbent particulate material and then immediately add the water. This may prevent the super absorbent polymer from dehydrating the absorbent particulate itself. Also, it may be ideal that the super absorbent particulate is properly hydrated, prior to its addition to the composition.

In one embodiment, the improved powdered cleaning composition may be manufactured according to the following steps: (a) providing a cleaning fluid solution which is comprised of a mixture of water, at least one surfactant and at least one biocide; (b) preparing a powder blend which is comprised of at least one absorbent particulate wherein said absorbent particulate has an average particle size of from about 10 to about 300 microns in diameter and an oil absorption value of at least 40 and at least one super absorbent polymer selected from the group consisting of crosslinked polyacrylic acid compounds; and (c) combining the cleaning fluid solution of step "a" with the powder blend of step "b." A small amount of fragrance (e.g. 0.04%) may be added to the mixture of step "a," prior to combining the cleaning fluid solution with the powder blend. Step "a" and step "b" may be performed either sequentially or simultaneously. Step "b" may be accomplished by using a commercial-sized blender, such as, for example, a ribbon blender. Step "c" may be accomplished by spraying the cleaning fluid solution of step "a" onto the powder blend of step "b" as the powder blend is being agitated in the ribbon blender.

Furthermore, the improved powdered cleaning composition may be manufactured according to the following steps:

(a) providing a cleaning fluid solution which is comprised of a mixture of:
  (i) between 20% and 90% by weight of water, wherein said water contains at least one surfactant sufficient to provide a surface tension of less than about 40 dynes per centimeter; and
  (ii) between 0.01% and 10% by weight of at least one biocide;
(b) providing a powder blend which is comprised of:
  (i) between 0.1% and 75% by weight of at least one absorbent particulate selected from the group consisting of a urea formaldehyde polymeric material, polyurethane, polystyrene, phenol-formaldehyde resin particles, water insoluble inorganic salt adjuvants, cellulosic particles, diatomaceous earth particles, wood particles, particles made from grains and other vegetable matter, inorganic particles and mixtures thereof, wherein said absorbent particulate has an average particle size of from about 10 to about 300 microns in diameter and an oil absorption value of at least 40; and
  (ii) between 0.1% and 20% by weight of at least one super absorbent polymer selected from the group consisting of crosslinked polyacrylic acid compounds; and
(c) combining the cleaning fluid solution of step "a" with the powder blend of step "b."

A small amount of fragrance (e.g. 0.04%) may be added to the mixture of step "a," prior to combining the cleaning fluid solution with the powder blend. Step "a" and step "b" may be performed either sequentially or simultaneously. Step "b" may be accomplished by using a commercial-sized blender, such as, for example, a ribbon blender. Step "c" may be accomplished by spraying the cleaning fluid solution of step "a" onto the powder blend of step "b" as the powder blend is being agitated in the ribbon blender.

Thus, the improved powdered cleaning composition may be manufactured according to following process:

(a) providing a cleaning fluid solution which is comprised of a mixture of:
  (i) 41.5% by weight water;
  (ii) 0.4% surfactant; and
  (iii) 1.1% biocide;
(b) providing a powder blend which is comprised of:
  (i) 41.5% urea formaldehyde polymer;
  (ii) 11.5% calcium carbonate; and
  (iii) 4% crosslinked polyacrylic acid compound; and
(c) combining the cleaning fluid solution of step "a" with the powder blend of step "b."

Step "a" and step "b" may be performed either sequentially or simultaneously. A small amount of fragrance (e.g. 0.04%) may be added to the mixture of step "a," prior to combining the cleaning fluid solution with the powder blend. Step "b" may be accomplished by using a commercial-sized blender, such as, for example, a ribbon blender. Step "c" may be accomplished by spraying the cleaning fluid solution of step "a" onto the powder blend of step "b" as the powder blend is being agitated in the ribbon blender.

Textile Substrate

The textile substrate to which the composition may be applied is most preferably a carpet or upholstery fabric. As used herein, the term "carpet" is intended to include, without limitation, broadloom carpets, carpet tiles, rugs, and other textile floor covering material that may be cleaned by the compositions and methods described herein. The upholstery fabric may be woven, knitted, nonwoven, or combinations thereof. The textiles substrates may be comprised of natural fibers, synthetic fibers, or combinations thereof. Synthetic fibers include, for example, polyester, acrylic, polyamide, polyolefin, polyaramid, polyurethane, regenerated cellulose, polyvinylacetate, and blends thereof. More specifically, polyester includes, for example, polyethylene terephthalate, polytriphenylene terephthalate, polybutylene terephthalate, polylactic acid, and combinations thereof. Polyamide includes, for example, nylon 6, nylon 6,6, and combinations thereof. Polyolefin includes, for example, polypropylene, polyethylene, and combinations thereof. Polyaramid includes, for example, poly-p-phenyleneteraphthalamid (i.e., Kevlar®), poly-m-phenyleneteraphthalamid (i.e., Nomex®), and combinations thereof. Natural fibers include, for example, wool, cotton, flax, and blends thereof.

The textile substrate may be formed from fibers or yarns of any size, including microdenier fibers and yarns (fibers or yarns having less than one denier per filament). The fabric may be comprised of fibers such as staple fiber, filament fiber, spun fiber, or combinations thereof.

The improved powder cleaning composition may be applied to a textile substrate by applying a sufficient amount of the composition to the substrate, agitating the composition on the substrate, allowing the soil laden composition to dry, and removing the soil laden composition from the substrate. Agitating may be accomplished, for example, by brushing the composition into the substrate. Removal of the soil laden composition from the substrate may be accomplished, for example, by vacuuming.

Various embodiments of the invention are shown by way of the Examples below, but the scope of the invention is not limited by the specific Examples provided herein.

EXAMPLES

The following Examples further illustrate the improved powder cleaning composition but are not to be construed as limiting the invention as defined in the claims appended hereto. All parts and percents given in these examples are by weight unless otherwise indicated. "N/A" indicates that no test data was available.

Test Procedures:

Spot Cleaning Test Procedure

This procedure was used to determine the effectiveness of various carpet cleaners to remove common household stains from carpet. This method also provided a way to compare different cleaners in their ability to remove stains. The carpet used for this test was a light colored (plain vanilla) residential broadloom Saxony carpet (pattern no. 2903) made of 100% nylon fiber having an even cut pile.

Procedure

1. The carpet specimen was cut into pieces 10"×13." One 10"×13" piece was used to test up to ten stains per cleaner. Enough pieces were cut to test all cleaners on each stain to be evaluated plus one additional sample was cut for use as a control. For example, to test 12 cleaners on each of 10 stains, 13 of the 10"×13" pieces were needed.
2. The ten stains were placed on each carpet piece using a standard carpet staining technique. Each staining material was applied to each piece of carpet. The typical household stains that were tested were: cola, shoe polish, lipstick, chocolate, motor oil, Kool aid, and soil/dirt. Stains are allowed to dry overnight after applying to the carpet.
3. One stain blanket to be cleaned by each cleaner was labeled. A Sharpie marker was used to label the backs of each stain blanket with the designated carpet cleaner. A code was used for each cleaner so that the evaluation would not be biased. One stain blanket was not cleaned and was used as a control to compare the effectiveness of each cleaner on stain removal.
4. Each stain was cleaned with the designated cleaner according to the package instructions (if commercial product) and allowed to dry overnight.
5. Five people, not involved in this project, were used to rank the residual stains after cleaning ranking from best to worse with 1 being the best. Rating: 1=completely removed, 2=very good (acceptable), 3=pretty good (borderline), 4=poor (unacceptable), 5=nothing removed (same as original).
6. The rankings were then averaged by cleaner and by stain. In some instances, only a visual notation was made to indicate whether the stains were removed in comparison to the control sample.

Cleaning Efficiency Test Procedure

This procedure was used to compare the cleaning ability (efficiency) of carpet cleaners using a standard soil in order to mimic carpet soiled by foot traffic.

Materials

Light colored, commercial grade, level cut pile carpet tiles (available from Milliken & Company of Spartanburg, S.C.)
3M Soil
CSI Tumbler and Soil Bomb
Analytical balance
Top-loading balances
GLS scrubbing Machine, Whittaker
Windsor vacuum cleaner
GretagMacbeth Color-Eye7000A Colorimeter Preparation 1. A clicking (i.e. die cut) machine was used to cut 4½"×4½" pieces of light tan commercial grade 18" cut pile carpet tile. Each product or formulation tested was run in triplicate.
2. A template was prepared by cutting a 4½"×4½" piece from the center of a tile. ⅛" of carpet was trimmed from the inside edges of the hole in the template to allow for a good fit.
3. Another whole tile was taped to the bottom edge of the template.

Procedure

1. A 4½"×4½" piece of tile was placed into the hole in the template.
2. The GLS machine was used to make 2 passes (up and back) over the template and test carpet.
3. The Windsor vacuum was used to make 5 passes over the template and test carpet. Going up and back is considered one pass.

4. Steps 1-3 were repeated for each carpet piece.
5. The LAB values of each carpet piece were measured on the Color-Eye. This reading was recorded as "Lo."
6. 1.5 g of 3M soil was added to the soil bomb.
7. Four of the prepared test carpet pieces were placed on the Soiling Tumbler and the soil bomb was added.
8. Samples were tumbled for 30 minutes.
9. Carpet pieces were removed from the tumbler, and vacuum as in step #3.
10. The LAB values were measured on the Color-Eye; these values were called "Ls." Ls values must be within ±3% (ex: Ls=42.0±1.3). Soiled pieces outside the proper range were not used.
11. Each tile was soiled, vacuumed and the LAB values were measured for all test carpet pieces as in steps 6-10.
12. The cleaning composition was then applied to the soiled carpet as described for each specific Example above.
13. The piece of carpet was then placed in the template.
14. The cleaning composition was scrubbed into the carpet using 3 passes with the GLS.
15. The carpet was removed from the template and was set aside to dry.
16. The empty template was vacuumed as in Step 3 above.
17. Steps 12-16 were repeated until all samples had been scrubbed.
18. When the cleaning composition had dried for 30 minutes (or the desired drying time), each piece was placed into the template and 5 passes were made with the Windsor vacuum.
19. The pieces were removed from the template and read on the Color-Eye; these values were called "Lc."
20. The cleaning efficiency was calculated for each piece using the formula below:

$$\text{Cleaning}=Lc-Ls\times 100$$

Efficiency Lo−Ls

21. Since three carpet pieces were used for each product or formulation, the average of the three cleaning efficiency values was reported.

Retrieval Test Procedure

This procedure was used to determine how much of a dry powder carpet cleaner or substrate can be retrieved from carpet tiles with a vacuum cleaner. The Ultimate Retrieval of a substrate from a carpet tile can also be determined using a vacuum with high air velocity. The carpet used for the test was light colored, commercial grade, level cut pile carpet tiles (available from Milliken & Company of Spartanburg, S.C.).

Procedure

1. Condition carpet tiles for 24 hours at the standard conditions of 50%±5% relative humidity and 65° F.±5°.
2. Place conditioned test tile on floor in the center of a 3 tile by 3 tile carpet template (template has a total of 8 tiles laid out in a square, with the center being empty for the conditioned tile). The template aids in preventing the tile from sliding around on the floor, and it also provides an even surface for vacuuming.
3. Make 4 passes over the test tile with vacuum (Windsor).
4. Weigh tile on balance. Record weight in notebook as "Tile Weight."
5. Using a sifter, sprinkle 30 grams of substrate on the tile.
6. Place tile back in template.
7. Using a GLS floor scrubber (manufactured by Whittaker), ensure that the GLS machine and brushes have been vacuumed to remove any residual powder. Using the GLS machine, make 2 passes over the test tile to work the substrate into the carpet.
8. Weigh tile on balance. Record weight in notebook as "Tile Weight+Wet Substrate."
9. Let tile dry for 30 minutes.
10. Weigh tile on balance. Record weight in notebook as "Tile Weight+Dry Substrate."
11. Place tile back in template.
12. Make 2 passes over the test tile with vacuum (Windsor).
13. Weigh tile on balance. Record weight in notebook as "Tile Weight After 2 Passes."
14. For Ultimate Retrieval, place tile back in template. Make 4 passes over tile with Windsor vacuum.
15. Weigh tile on balance. Record weight in notebook as "Tile Weight After 6 Passes."
16. Calculate Retrieval using calculation A.
17. Calculate Ultimate Retrieval using calculation B.

Calculations $$\text{RETRIEVAL}=\frac{\left(\begin{array}{c}\text{Tile Weight + Wet Substrate −}\\ \text{Tile Weight After 2 Passes}\end{array}\right)}{(\text{Tile Weight + Wet Substrate − Tile Weight})}\times 100 \quad \text{A.}$$

$$\text{ULTIMATE RETRIEVAL}=\frac{\left(\begin{array}{c}\text{Tile Weight + Wet Substrate −}\\ \text{Tile Weight After 6 Passes}\end{array}\right)}{(\text{Tile Weight + Wet Substrate − Tile Weight})}\times 100 \quad \text{B.}$$

Examples 1-9

Various inventive powder cleaning compositions containing super absorbent polymer and comparative cleaning compositions were made and tested for various properties. The formulations and procedures are described below.

Examples 1A-1B

The product consistency and flow properties of the inventive powder cleaning composition versus a comparative composition were evaluated as the amount of moisture (i.e. water) was increased from 30% to 70%. The formulations were prepared by blending together the components using techniques known to those skilled in the art and/or according to the methods as described herein.

Visual observations of the prepared formulations were made and are provided in Table 1.

Example 1A Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 66.0 |
| Luquasorb ® 1245 (super absorbent polymer - a crosslinked polyacrylic acid compound available from BASF) | 4.0 |
| Water | 30.0 |

Example 1B Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 26.0 |
| Luquasorb ® 1245 (super absorbent polymer - a crosslinked polyacrylic acid compound available from BASF) | 4.0 |
| Water | 70.0 |

Comparative Example 1A Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 70.0 |
| Water | 30.0 |

Comparative Example 1B Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 30.0 |
| Water | 70.0 |

TABLE 1

Product Consistency and Flow Properties With Increase in Moisture Content

| Sample | Moisture Content | Results |
|---|---|---|
| Example 1A | 30% | Free-flowing powder. |
| Example 1B | 70% | Free-flowing powder. Very little clumping. |
| Comparative Example 1A | 30% | Clumpy powder. |
| Comparative Example 1B | 70% | Liquid mixture with powder settled to bottom. |

The test results show that product consistency and flow properties are improved with the addition of SAP to the inventive powder cleaning composition. More specifically, Example 1B exhibits the ability to remain a free-flowing powder, even though the moisture content was increased from 30% to 70%. In contrast, Comparative Example 1B became a liquid mixture with powder settling to the bottom of the container. Thus, the incorporation of SAP into the formulation allows for significantly higher moisture content within the powder cleaning composition.

Examples 2A-2E and 3A-3E

The product consistency and flow properties of the inventive powder cleaning composition versus a comparative composition were evaluated as the amount of SAP (i.e. crosslinked polyacrylic acid) was incrementally increased from 0% to 30%. The formulations were prepared by blending together the components using techniques known to those skilled in the art.

Visual observations of the prepared formulations were made and are provided in Table 2.

Example 2A Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 100 |
| Luquasorb ® 1245 (super absorbent polymer - a crosslinked polyacrylic acid compound available from BASF) | 0.0 |

Example 2B Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 99 |
| Luquasorb ® 1245 (super absorbent polymer - a crosslinked polyacrylic acid compound available from BASF) | 1 |

Example 2C Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 96 |
| Luquasorb ® 1245 (super absorbent polymer - a crosslinked polyacrylic acid compound available from BASF) | 4 |

Example 2D Formulation

| Component | Amount (percent) |
|---|---|
| Capture ® Carpet and Rug Cleaner (commercially available powdered carpet cleaner | 85 |

-continued

| Component | Amount (percent) |
|---|---|
| manufactured by Milliken & Company; contains urea formaldehyde polymer having a 35-40% moisture content) | |
| Luquasorb ® 1245 (super absorbent polymer - a crosslinked polyacrylic acid compound available from BASF) | 15 |

Example 2E Formulation

| Component | Amount (percent) |
|---|---|
| Capture ® Carpet and Rug Cleaner (commercially available powdered carpet cleaner manufactured by Milliken & Company; contains urea formaldehyde polymer having a 35-40% moisture content) | 70 |
| Luquasorb ® 1245 (super absorbent polymer - a crosslinked polyacrylic acid compound available from BASF) | 30 |

Examples 3A-3E Formulations

Examples 3A-3E were prepared similar to Examples 2A-2E, except that the Capture® Carpet and Rug Cleaner was replaced with a commercially available brown sugar composition.

TABLE 2

Product Consistency and Flow Properties With Increase in SAP Content

| Sample | Amount of SAP (%) | Absorbent Particulate | Results |
|---|---|---|---|
| Example 2A | 0 | UFP | Clumpy powder. Sticky, bridges. Does not flow well. |
| Example 2B | 1 | UFP | Some improvements in stickiness. |
| Example 2C | 4 | UFP | Much improved. Better flow. Slight sticking and bridging. |
| Example 2D | 15 | UFP | Free-flowing powder. |
| Example 2E | 30 | UFP | Fully free-flowing powder. |
| Example 3A | 0 | Brown sugar | Clumpy. No flow. Packs. |
| Example 3B | 1 | Brown sugar | Some separation, but not much improvement. |
| Example 3C | 4 | Brown sugar | Very slight improvement. |
| Example 3D | 15 | Brown sugar | Some improvement, once broken up. |
| Example 3E | 30 | Brown sugar | Definitely better. Almost free-flowing. |

The test results show that product consistency and flow properties are improved with the addition of SAP to the inventive powder cleaning composition and to other moisture-containing systems (e.g. brown sugar). More specifically, Examples 2A-2E and 3A-3E exhibit improved flow properties as the amount of SAP was incrementally increased from 0% to 30%. Thus, the test results illustrate the advantage of incorporating SAP as a flow aid in moisture-containing systems.

Examples 4A-4E

This example demonstrates the difference between the use of a crosslinked polyacrylic acid compound versus non-crosslinked acrylic-containing compounds. The flow properties of the formulations incorporating each acrylic-containing compound were observed as the amount of each acrylic-containing compound was incrementally increased in the formulations. The formulations were prepared by blending together the components using techniques known to those skilled in the art.

Visual observations of the prepared formulations were made and are provided in Table 3.

Example 4A-4E Formulations

Examples 4A-4E were prepared the same as in Examples 2A-2E.

Comparative Examples 2A-2E Formulations

Comparative Examples 2A-2E were prepared the same as Examples 4A-4E, except that Luquasorb® 1245 was replaced with Acrysol™ 8306 (15% solids), a non-crosslinked polyacrylic acid available from Rohm & Haas.

Comparative Examples 3A-3E Formulations

Comparative Examples 3A-3E were prepared the same as Examples 4A-4E, except that Luquasorb® 1245 was replaced with PD-75 (15% solids), an acid-containing acrylic copolymer available from Milliken & Company of Spartanburg, S.C.

TABLE 3

Product Consistency and Flow Properties With Various Acrylic-Containing Compounds

| Sample | Amount of Acrylic-Containing Compound (%) | Acrylic-Containing Compound | Results |
|---|---|---|---|
| Example 4A | 0 | None. | Clumpy powder. Sticky, bridges. Does not flow well. |
| Example 4B | 1 | Crosslinked polyacrylic acid | Some improvements in stickiness. |
| Example 4C | 4 | Crosslinked polyacrylic acid | Much improved. Better flow. Slight sticking and bridging. |
| Example 4D | 15 | Crosslinked polyacrylic acid | Free-flowing powder. |
| Example 4E | 30 | Crosslinked polyacrylic acid | Fully free-flowing powder. |
| Comparative Example 2A | 0 | None. | N/A |
| Comparative Example 2B | 1 | Non-crosslinked polyacrylic acid | Clumpy powder. Sticky, bridges. Does not flow well. |
| Comparative Example 2C | 4 | Non-crosslinked polyacrylic acid | Some improvement in stickiness, but grainier. |
| Comparative Example 2D | 15 | Non-crosslinked polyacrylic acid | Paste. |
| Comparative Example 2E | 30 | Non-crosslinked polyacrylic acid | Very wet paste. |
| Comparative Example 3A | 0 | None. | N/A |
| Comparative Example 3B | 1 | Acid-containing acrylic copolymer | Clumpy powder. Sticky, bridges. Does not flow well. |
| Comparative Example 3C | 4 | Acid-containing acrylic copolymer | Some improvement in stickiness, but grainier. |
| Comparative Example 3D | 15 | Acid-containing acrylic copolymer | Watery and separation between liquid and powder. |

TABLE 3-continued

| Product Consistency and Flow Properties With Various Acrylic-Containing Compounds | | | |
|---|---|---|---|
| Sample | Amount of Acrylic-Containing Compound (%) | Acrylic-Containing Compound | Results |
| Comparative Example 3E | 30 | Acid-containing acrylic copolymer | Watery and separation between liquid and powder. |

The test results show that product consistency and flow properties are improved with the addition of crosslinked polyacrylic acid to the inventive powder cleaning composition. More specifically, Examples 4A-4E exhibit improved flow properties as the amount of crosslinked polyacrylic acid was incrementally increased from 0% to 30%. In contrast, Comparative Examples 2A-2E and 3A-3E did not produce a flowable powder cleaning composition with the incorporation of non-crosslinked, acrylic-containing compounds. In addition, Comparative Examples 2A-2E and 3A-3E produced an unattractive odor.

Example 5

The product consistency and flow properties of the inventive powder cleaning composition containing a cellulose-based absorbent particulate were observed as the amount of SAP (i.e. crosslinked polyacrylic acid) was incrementally increased from 0% to 30%. The formulations were prepared by blending together the components using techniques known to those skilled in the art.

Visual observations of the prepared formulations were made and are provided in Table 4.

Example 5 Formulation

| Component | Amount (percent) |
|---|---|
| Host ® Dry Carpet Cleaner (a cellulose-based carpet cleaner with a water-based surfactant, available from Racine Industries Inc.) | as described below |
| Luquasorb ® 1245 (super absorbent polymer - a crosslinked polyacrylic acid compound available from BASF) | as described below |

TABLE 4

| Product Consistency and Flow Properties of Cellulose-Based Cleaner With Increase in SAP Content | | |
|---|---|---|
| Amount of SAP | Amount of Cellulose-Based Cleaner | Example 5 |
| 0% | 100 | Clumpy, sticky powder. |
| 1% | 99 | Somewhat free-flowing. Less sticky. |
| 4% | 96 | Free-flowing and not sticky. |
| 15% | 85 | Free-flowing powder. |
| 30% | 70 | Free-flowing powder. |

The test results show that product consistency and flow properties are improved with the addition of SAP to the inventive powder cleaning composition comprised of a cellulose-based powder cleaning composition. More specifically, Example 5 exhibits improved flow properties as the amount of SAP was incrementally increased from 0% to 30%. Thus, the test results illustrate the advantage of incorporating SAP as a flow aid in moisture-containing systems.

Examples 6A-6C

This cleaning performance of the powder cleaning composition of the present invention was evaluated and compared with the cleaning performance of Comparative Example 1. The formulations were prepared according to the methods as described herein.

Each formulation was tested for cleaning performance according to the Spot Cleaning Test Procedure described herein. The cleaned carpet was allowed to dry overnight and then visual observations of the cleaning performance of the prepared formulations were made. Test results are provided in Table 5.

Example 6A Formulation

| Component | Amount (percent) |
|---|---|
| Urea Formaldehyde Polymer ("UFP", as described in U.S. Pat. No. 3,910,848 having 35-40% moisture content) | 41.7 |
| Calcium Carbonate (inorganic salt) | 11.5 |
| Water | 41.7 |
| Pluronic ® LF62 (a surfactant available from BASF) | 0.4 |
| Potassium Sorbate (a biocide) | 0.6 |
| Kathon ™ (an isothiazolone biocide available from Rohm and Haas) | 0.06 |
| Fragrance | 0.04 |
| Luquasorb ® 1245 (super absorbent polymer - a crosslinked polyacrylic acid compound available from BASF) | 4.0 |

Example 6B Formulation

Example 6B was the same as Example 6A, except that the amount of Pluronic® LF62 was increased from 0.4% to 0.8%.

Example 6C Formulation

Example 6C was the same as Example 6A, except that the amount of Pluronic® LF62 was increased from 0.4% to 4%.

TABLE 5

| Cleaning Performance | | | | | | | | |
|---|---|---|---|---|---|---|---|---|
| | Spotting Substance | | | | | | | |
| Sample | Cola | Shoe Polish | Lip-stick | Chocolate | Soil/ Dirt | Burnt Motor Oil | Kool-Aid | Average |
| Comparative Example 1 | 1 | 1 | 1 | 2 | 2 | 1 | 1 | 1.3 |
| Example 6A | 1 | 2 | 2 | 2 | 2 | 2 | 2 | 1.9 |
| Example 6B | 1 | 2 | 2 | 2 | 2 | 1 | 1 | 1.6 |
| Example 6C | 1 | 2 | 2 | 2 | 2 | 1 | 2 | 1.7 |

The test results show that the powder cleaning composition of the present invention removed the spots as well as a powder cleaning composition that does not contain a super absorbent polymer. However, it was noted that as the amount of surfactant was increased, the cleaning efficiency of the composition did not significantly improve. In fact, Example 6C appeared to mat the fibers of the carpet more than the other compositions. Thus, it appears that the presence of the super absorbent polymer does not significantly affect the cleaning efficiency and/or performance of the cleaning composition in a detrimental manner.

Examples 7A-7E

This cleaning performance of the powdered cleaning composition of the present invention was evaluated and compared with the cleaning performance of Comparative Example 1. The formulations were prepared according to the methods as described herein.

Each formulation was tested for cleaning performance according to the Spot Cleaning Test Procedure described herein. The cleaned carpet was allowed to dry overnight and then visual observations of the cleaning performance of the prepared formulations were made. Test results are provided in Table 6.

Example 7A Formulation

| Component | Amount (percent) |
|---|---|
| Urea Formaldehyde Polymer ("UFP", as described in U.S. Pat. No. 3,910,848 having 35-40% moisture content) | 41.7 |

-continued

| Component | Amount (percent) |
|---|---|
| Calcium Carbonate (inorganic salt) | 11.5 |
| Water | 43.83 |
| Pluronic ® LF62 (a surfactant available from BASF) | 0.37 |
| Potassium Sorbate (a biocide) | 0.6 |
| Kathon ™ (an isothiazolone biocide available from Rohm and Haas) | 0.06 |
| Fragrance | 0.04 |
| Luquasorb ® 1245 (super absorbent polymer - a crosslinked polyacrylic acid compound available from BASF) | 1.9 |

Example 7B Formulation

Example 7B was the same as Example 7A, except that the amount of SAP was 1.6%, and the amount of water was 44.13%.

Example 7C Formulation

Example 7C was the same as Example 7A, except that the amount of SAP was 4.2%, and the amount of water was 41.53%.

Example 7D Formulation

Example 7D was the same as Example 7A, except that the amount of SAP was 7.1%, and the amount of water was 38.63%.

Example 7E Formulation

Example 7E was the same as Example 7A, except that the amount of SAP was 6.0%, and the amount of water was 39.73%.

TABLE 6

| Cleaning Performance | | | | | | | | |
|---|---|---|---|---|---|---|---|---|
| | Spotting Substance | | | | | | | |
| Sample | Cola | Shoe Polish | Lip-stick | Chocolate | Soil/ Dirt | Burnt Motor Oil | Kool-Aid | Average |
| Comparative Example 1 | 1 | 1 | 1.8 | 1 | 1 | 1 | 2 | 1.3 |
| Example 7A | 1 | 2 | 2.2 | 1.2 | 1.2 | 1 | 2 | 1.5 |
| Example 7B | 1 | 1.2 | 2 | 1 | 1 | 1 | 2 | 1.3 |
| Example 7C | 1 | 3.4 | 3.4 | 2 | 2 | 1 | 2 | 2.1 |
| Example 7D | 1 | 3 | 3.2 | 2 | 2.4 | 1 | 2 | 2.1 |
| Example 7E | 1 | 2.4 | 3 | 2.2 | 1.8 | 1 | 2 | 1.9 |

The test results show that the powder cleaning composition of the present invention removed the spots as well as a powder cleaning composition that does not contain a super absorbent polymer. However, Examples 7C-7E may illustrate that increasing amounts of SAP in the cleaning composition may actually detrimentally affect the cleaning performance of the composition. Thus, these results may suggest that there is an ideal range of the amount of SAP that is included in the composition which provides a preferred balance between the flow characteristics and the cleaning performance of the composition.

Example 8

The cleaning efficiency of the powder cleaning composition of Example 8 was evaluated and compared with the cleaning performance of Comparative Example 1 and Comparative Example 4. The formulations were prepared according to the methods as described herein.

Each formulation was tested for cleaning performance according to the Cleaning Efficiency Test Procedure described herein. Each sample had four carpet samples that were soiled and cleaned with the specific product. Before the soiling, after the soiling and after the cleaning the samples were analyzed by reading the Delta E values for each. The averages of these values for each product were calculated and were compared to determine the differences between them.

The cleaned carpet was allowed to dry overnight and then visual observations of the cleaning performance of the prepared formulations were made. Test results are provided in Table 7.

Example 8 Formulation

| Component | Amount (percent) |
|---|---|
| Urea Formaldehyde Polymer ("UFP", as described in U.S. Pat. No. 3,910,848 having 35-40% moisture content) | 42.6 |
| Calcium Carbonate (inorganic salt) | 11.7 |
| Water | 40.8 |
| Pluronic ® LF62 (a surfactant available from BASF) | 0.30 |
| Potassium Sorbate (a biocide) | 0.60 |
| Kathon ™ (an isothiazolone biocide available from Rohm and Haas) | 0.06 |
| Fragrance | 0.04 |
| Luquasorb ® 1245 (super absorbent polymer - a crosslinked polyacrylic acid compound available from BASF) | 3.9 |

Comparative Example 4 Formulation

Comparative Example 4 (also referred to as "Comp. Example 4") was the same as Comparative Example 1, except that Comparative Example 4 did not contain any fragrance.

TABLE 7

Cleaning Efficiency Results

| Sample | Status | L* Value | a* Value | b* Value | Delta E* Value |
|---|---|---|---|---|---|
| Example 8 | Soiled | 46.52 | 2.469 | 11.203 | |
| Example 8 | Cleaned | 54.484 | 2.101 | 13.137 | 8.204 |

TABLE 7-continued

Cleaning Efficiency Results

| Sample | Status | L* Value | a* Value | b* Value | Delta E* Value |
|---|---|---|---|---|---|
| Example 8 | Soiled | 46.331 | 2.448 | 11.184 | |
| Example 8 | Cleaned | 54.941 | 2.108 | 13.342 | 8.883 |
| Example 8 | Soiled | 46.606 | 2.487 | 11.323 | |
| Example 8 | Cleaned | 55.614 | 2.211 | 13.742 | 9.331 |
| Example 8 | Soiled | 46.129 | 2.41 | 10.994 | |
| Example 8 | Cleaned | 54 | 2.164 | 13.384 | 8.23 |
| Average of Example 8 | | | | | 8.662 |
| Comp. Example 1 | Soiled | 47.091 | 2.457 | 11.389 | |
| Comp. Example 1 | Cleaned | 53.995 | 2.305 | 13.316 | 7.17 |
| Comp. Example 1 | Soiled | 46.734 | 2.387 | 11.146 | |
| Comp. Example 1 | Cleaned | 53.797 | 2.199 | 12.814 | 7.259 |
| Comp. Example 1 | Soiled | 46.064 | 2.382 | 10.884 | |
| Comp. Example 1 | Cleaned | 53.43 | 2.218 | 12.703 | 7.59 |
| Comp. Example 1 | Soiled | 46.749 | 2.397 | 11.221 | |
| Comp. Example 1 | Cleaned | 54.492 | 2.226 | 13.098 | 7.969 |
| Average of Comp. Example 1 | | | | | 7.497 |
| Comp. Example 4 | Soiled | 45.843 | 2.346 | 10.845 | |
| Comp. Example 4 | Cleaned | 51.291 | 2.194 | 12.305 | 5.642 |
| Comp. Example 4 | Soiled | 45.096 | 2.334 | 10.514 | |
| Comp. Example 4 | Cleaned | 51.667 | 2.201 | 12.326 | 6.818 |
| Comp. Example 4 | Soiled | 46.002 | 2.379 | 10.951 | |
| Comp. Example 4 | Cleaned | 52.502 | 2.228 | 12.672 | 6.726 |
| Comp. Example 4 | Soiled | 45.76 | 2.364 | 10.74 | |
| Comp. Example 4 | Cleaned | 51.505 | 2.243 | 12.437 | 5.992 |
| Average of Comp. Example 4 | 4.44 | | | | 6.295 |

Test results show that in comparing the three different samples—Example 8, Comparative Example 1 and Comparative Example 4—there were no significant differences in cleaning efficiency.

Example 8 had an average Delta E value of 8.662. This value was the difference between the soiled carpet sample and the cleaned carpet sample. Example 8 also exhibited the largest Delta E value observed, which appears to illustrate that this product cleaned the best out of the three samples.

Comparative Example 1 had the average Delta E value of 7.497. The Delta E values were calculated using the same process as Example 8. Comparative Example 1 exhibited a larger Delta E value than Comparative Example 4.

Comparative Example 4 had an average Delta E value of 6.295. The Delta E values were also calculated using the same process as Example 8. Comparative Example 4 exhibited the lowest calculated Delta E value during this experiment. Thus, the results indicate that Comparative Example 4 exhibited the smallest difference between the soiled and the cleaned carpet samples.

Example 9

This retrieval efficiency of the powder cleaning composition of Example 8 was evaluated and compared with the retrieval efficiency of Comparative Example 1 and Comparative Example 4. Each formulation was tested for retrieval performance according to the Retrieval Test Procedure described herein. The averages of these values for each product were calculated and were compared to determine the differences between them.

The cleaned carpet was allowed to dry overnight and then visual observations of the retrieval performance of the prepared formulations were made. Test results are provided in Table 8.

TABLE 8

Retrieval Efficiency Results

| Sample | Tile Weight (g) | Tile + Dry substrate (g) | Tile + Dry substrate (g) | Tile After 2 Passes (g) | Tile After 6 Passes (g) | Retrieval After 2 Passes | Retrieval After 6 Passes |
|---|---|---|---|---|---|---|---|
| Example 8 | 949.76 | 966.24 | 962.44 | 953.54 | 952.4 | 77.1 | 84.0 |
| Example 8 | 951.96 | 969.68 | 964.96 | 955.96 | 954.66 | 77.4 | 84.8 |
| Example 8 | 946.86 | 964.38 | 959.28 | 950.2 | 949.22 | 80.9 | 86.5 |
| Average of Example 8 | | | | | | 78.5 | 85.1 |
| Comp. Example 1 | 951.24 | 961.28 | 959.1 | 953.74 | 952.46 | 75.1 | 87.8 |
| Comp. Example 1 | 947.06 | 957.1 | 955.3 | 949.2 | 948.2 | 78.7 | 88.6 |
| Comp. Example 1 | 950.12 | 960.02 | 958.44 | 952.58 | 951.44 | 75.2 | 86.7 |
| Average of Comp. Example 1 | | | | | | 76.3 | 87.7 |
| Comp. Example 4 | 947.18 | 958.34 | 956.66 | 949.46 | 948.8 | 79.6 | 85.5 |
| Comp. Example 4 | 947.9 | 958.5 | 956.76 | 950.06 | 949.12 | 79.6 | 88.5 |
| Comp. Example 4 | 947.7 | 959.48 | 957.69 | 950.36 | 949.62 | 77.4 | 83.7 |
| Average of Comp. Example 4 | | | | | | 78.9 | 85.9 |

The test results show that in comparing the three different samples—Example 8, Comparative Example 1 and Comparative Example 4—there were no significant differences in retrieval efficiency.

Thus, the improved powder cleaning composition described herein provides compositions that contain absorbent particulate materials and super absorbent polymers that remain a free-flowing powder composition, while containing a higher water content than previous powder cleaning compositions. The inclusion of a super absorbent polymer does not detrimentally affect the cleaning and retrieval efficiency of the improved powder cleaning composition. Accordingly, this invention represents novel advancement in the art of cleaning compositions.

These and other modifications and variations to the present invention may be practiced by those of ordinary skill in the art, without departing from the spirit and scope of the present invention. Furthermore, those of ordinary skill in the art will appreciate that the foregoing description is by way of example only and is not intended to limit the scope of the invention described in the appended claims.

We claim:

1. A powder cleaning composition for a textile substrate consisting of:

(a) between 0.1% and 75% by weight of an absorbent particulate, wherein said absorbent particulate is a urea formaldehyde polymeric material, wherein said absorbent particulate has an average particle size of from about 10 to about 300 microns in diameter and an oil absorption value of at least 40;

(b) between 0.1% and 20% by weight of a super absorbent polymer, wherein said super absorbent polymer is a cross-linked polyacrylic acid compound;

(c) between 20% and 90% by weight of water;

(d) a surfactant sufficient to provide a surface tension of less than about 40 dynes per centimeter; and (e) between 0.01% and 10% by weight of at least one additive selected from an organic liquid, a stain resist agent, a pH adjuster, a biocide, a static reducing additive, a dust suppressing additive, a vacuum retrieval additive, a metal ion chelator, and a fragrance.

2. The powder cleaning composition of claim 1, wherein said average particle size of said absorbent particulate is from about 35 to about 105 microns.

3. The powder cleaning composition of claim 1, wherein said absorbent particulate is between 10% and 65% by weight.

4. The powder cleaning composition of claim 1, wherein said absorbent particulate is between 25% and 60% by weight.

5. The powder cleaning composition of claim 1, wherein said super absorbent polymer is between 1% and 10% by weight.

6. The powder cleaning composition of claim 1, wherein said super absorbent polymer is between 3% and 8% by weight.

7. The powder cleaning composition of claim 1, wherein said water is between 30% and 70% by weight.

8. The powder cleaning composition of claim 1, wherein said water is between 40% and 60% by weight.

9. The powder cleaning composition of claim 1, wherein said surfactant is selected from the group consisting of nonionic surfactants, anionic surfactants, cationic surfactants, and combinations thereof.

10. The powder cleaning composition of claim 9, wherein said surfactant is a nonionic surfactant, and wherein said nonionic surfactant has the formula:

$$R(OCH(C_nH_{2n+1})—CH2)_mR^1$$

where n is 0 or 1, m is 3 to 20, $R^1$ is OH or $OCH_3$, R is $C_{12}$ to $C_{22}$ alkyl or phenyl or naphthyl optionally substituted by $C_1$ to $C_{10}$ alkyl groups.

11. The powder cleaning composition of claim 9, wherein said surfactant is an anionic surfactant, and wherein said anionic surfactant is a long chain alcohol sulfate ester or an alkylene oxide additive of $C_6$-$C_{10}$ mono and diesters of orthophosphoric acid.

12. The powder cleaning composition of claim 1, wherein said organic liquid is selected from the group consisting of $C_1$ to $C_4$ aliphatic alcohols, high boiling hydrocarbon solvents and mixtures thereof.

13. The powder cleaning composition of claim 1, wherein said biocide is selected from the group consisting of potassium sorbate, an isothiazolone compound and mixtures thereof.

14. A powder cleaning composition for a textile substrate consisting of:

(a) between 10% and 65% by weight of an absorbent particulate, wherein said absorbent particulate is a urea formaldehyde polymeric material, wherein said absorbent particulate has an average particle size of from about 10 to about 300 microns in diameter and an oil absorption value of at least 40;

(b) between 1% and 10% by weight of a super absorbent polymer, wherein said super absorbent polymer is a cross-linked polyacrylic acid compound;

(c) between 30% and 70% by weight of water;

(d) a surfactant sufficient to provide a surface tension of less than about 40 dynes per centimeter; and (e) between 0.01% and 10% by weight of at least one additive selected from an organic liquid, a stain resist agent, a pH adjuster, a biocide, an aerosol propellant, a static reducing additive, a dust suppressing additive, a vacuum retrieval additive, a metal ion chelator, and a fragrance.

15. A powder cleaning composition for a textile substrate consisting of:

(a) between 25% and 60% by weight of an absorbent particulate, wherein said absorbent particulate is a urea formaldehyde polymeric material, wherein said absorbent particulate has an average particle size of from about 10 to about 300 microns in diameter and an oil absorption value of at least 40;

(b) between 3% and 8% by weight of a super absorbent polymer, wherein said super absorbent polymer is a cross-linked polyacrylic acid compound;

(c) between 40% and 60% by weight of water;

(d) a surfactant sufficient to provide a surface tension of less than about 40 dynes per centimeter; and (e) between 0.01% and 10% by weight of at least one additive selected from an organic liquid, a stain resist agent, a pH adjuster, a biocide, an aerosol propellant, a static reducing additive, a dust suppressing additive, a vacuum retrieval additive, a metal ion chelator, and a fragrance.

* * * * *